United States Patent [19]

Black et al.

[11] Patent Number: 4,787,325

[45] Date of Patent: Nov. 29, 1988

[54] CLOTH PLY FOLDING AND SEWING APPARATUS AND METHOD

[75] Inventors: Marshall Black, Vidalia, Ga.; E. V. Humphreys, Jr., Blue Springs, Miss.; William O. Mitchell, Vidalia, Ga.

[73] Assignee: Oxford Industries, Inc., Vidalia, Ga.

[21] Appl. No.: 773,820

[22] Filed: Sep. 9, 1985

[51] Int. Cl.[4] ..... D05B 33/00

[52] U.S. Cl. ..... 112/121.29; 112/262.3; 112/262.1

[58] Field of Search ..... 112/121.11, 121.12, 112/121.13, 121.14, 121.15, 121.29, 262.3, 262.1; 271/148, 215; 270/40, 58

[56] References Cited

U.S. PATENT DOCUMENTS

| | | | |
|---|---|---|---|
| 3,386,396 | 6/1968 | Jacobs et al. . | |
| 3,539,177 | 11/1970 | Schwenk et al. . | |
| 3,611,957 | 10/1971 | Beazley | 112/121.29 |
| 3,986,467 | 10/1976 | Hornkohl | 112/121.29 |
| 4,176,832 | 12/1979 | Hughes et al. . | |
| 4,462,585 | 7/1984 | Gieson et al. . | |
| 4,483,262 | 11/1984 | Keeton | 112/121.29 |
| 4,502,675 | 3/1985 | Clark et al. | 270/40 |
| 4,579,329 | 4/1986 | Frost et al. . | |
| 4,615,288 | 10/1986 | Matsuda | 112/121.29 |

FOREIGN PATENT DOCUMENTS

| | | | |
|---|---|---|---|
| 1109671 | 5/1984 | U.S.S.R. | 270/40 |

*Primary Examiner*—Ronald Feldbaum

*Attorney, Agent, or Firm*—Jones, Askew & Lunsford

[57] ABSTRACT

An automatic and operator-unattended apparatus and method for forming a stitched coin pocket in a ply of material. A continuous length of material is provided to a folding station, which imparts a generally Z-shaped fold in the material by moving parallel plates along paths substantially parallel to each other, while the material is held by holding plates. A carriage with gripping fingers holds the fold in place while moving the length of material out to a predetermined length. A cutter cuts the material into a predetermined length. The carriage then pulls the ply of material through a sewing station where the fold is stitched. The carriage then places the sewn folded ply atop a stack of similarly formed articles by positively depositing same on the top of the stack. An improved stacking apparatus presents a substantially flat stacking surface for the article by allowing tilting of the stacking table to compensate for the increased thickness at one end of the ply due to the presence of the folded region.

21 Claims, 6 Drawing Sheets

CLOTH PLY FOLDING AND SEWING APPARATUS AND METHOD

TECHNICAL FIELD

The present invention relates generally to material handling, and specifically relates to a method and apparatus for forming a separate ply of material, sewing a coin pocket in the ply, and stacking the sewn folded plies automatically, particularly suitable for use in forming a coin pocket in a coat pocket liner.

BACKGROUND

In the garment manufacturing industry, clothing is often manufactured by cutting large, rectangular pieces of material from 100–150 yard rolls, followed by placing stacks of the cut pieces of material on a marker table for cutting. A pattern for cutting the material is then placed on top of the stack in preparation for cutting either by handknife or by an automatic cloth cutter such as a laser cutter. A computer optimizes the placement of the patterns on the cloth to maximize usage of material, and prepares a pattern to be used as a guide for cutting the material. After the material is cut, it must be bundled and carried to further processing stations where the material is folded, sewn, or subjected to further processing operations.

One particular type of folded ply encountered in the manufacture of men's suits is the coin pocket liner. Currently popular men's suits typically include a separately-formed coin pocket within the main jacket pocket to allow the wearer to carry coins or other small articles separately from other items in the pocket. In prior art methods of manufacture, material for forming the coin pocket is obtained as described above, requiring use of liner material to form a stack of generally rectangular plies for forming the coin pocket. The coin pockets are formed manually by folding each ply in a generally Z-shape, stitching or tacking the fold so that the fold does not separate during further processing, manually stacking and bundling the sewn folded plies, and transferring the plies to another processing station where the liner with coin pocket is sewn into the jacket of a garment.

Prior to the present invention, it has not been possible to efficiently automate the process of manufacturing such folded, sewn plies for various reasons. If the separate plies of material are cut and stacked in the conventional manner using a market table and pattern, the plies must be individually isolated and removed from the stack so that the material can be fed into subsequent processing equipment. Difficulties have been encountered in prior art material handling devices in that it has proven difficult to isolate and separate a single ply of material from a stack of material due to the tendency of pliable material such as cloth to adhere because of static electricity, frictional clinging, and thread entanglement.

Additional difficulties are encountered in automating the folding operation. Folding operations are only accurate when material is provided and handled in an aligned manner, which is difficult with pliable material such as cloth. Moreover, the material must be kept aligned when being fed to a sewing machine, lest the material become skewed and end up with an unacceptable stitch.

After a single ply is isolated, folded, and sewn, there still remains the problem of stacking the material so that it may be bundled for transfer to another processing station. Since folded plies such as those for use as coin pocket liners are thicker at one end than the other due to the fold, it has proven difficult to automatically stack the material due to the tendency of the stack to become higher toward the end including the fold than at the opposite end. This unevenness in stack height at opposite ends of the stack presents a problem in presenting a stacking surface for plies presented for stacking and bundling.

Some prior art stacking devices suffer from skewed, uneven stacks due to "dropping" of a ply onto the stack. This generally results from releasing the article to be stacked to fall onto the stack without positive guidance. Since pliable cloth plies are susceptible to air currents and unevenness in the stacking surface, releasing a ply to fall on to the top of a stack often results in skewed or uncentered stacking. This slows down subsequent operations since an operator or subsequent processing machine cannot be certain of picking up an edge of a ply at the same place in the stack every time.

SUMMARY OF THE INVENTION

The present invention overcomes these and other problems encountered in prior art and manual approaches to forming folded sewn plies by providing an apparatus and method for forming a folded sewn ply from a continuous supply roll and automatically stacking same. The system is fully automatic and operator-unattended: an operator loads a roll of material and thread, and returns when the stack of completed articles is full. The system is self-monitoring and shuts down if a problem is detected. Advantageously, many problems in prior art material handling approaches are solved by forming the material from a continuous roll of material precut to the appropriate width, by providing the leading edge of the material into the apparatus, and then positively handling only the leading edge of the material completely through the all folding, cutting, sewing, and stacking operations, thereby avoiding any problems with attempting to isolate and separately handle a single ply. In addition, the ply is positively deposited, not released to fall, onto the stack, thereby providing a neat, centered stack.

Briefly described, the present invention comprises an apparatus and method for forming a folded ply of material by first holding one end of a length of material from a supply roll precut to an appropriate width. An automatic folding station folds the material in a generally Z-shape to form a folded region while the one end is held. After folding, the material is grasped by gripping fingers mounted on a traveling carriage, withdrawn from the folding station, and cut to form a single elongate folded ply. The gripping fingers grasp the folded region along the lateral edges of the ply, and the ply is then pulled through a sewing station. While the ply is still held by the gripping fingers, the speed of movement of the gripping fingers through the sewing station is then synchronized to the speed of the sewing machine, and the folded region is stitched or tacked to hold the fold.

After stitching, the sewn folded ply, which is thicker at one end than the other due to the fold, is presented to a stacking table or elevator in a stacking station. The sewn folded ply is then presented to a stacking surface comprising the top of a stack of similar articles, and the stacking table is lowered. While the stack elevator is lowered, the gripping fingers are then brought back across the top of the stack toward the folding station to grip another folded ply, which has now been completed at the folding station. The stacking station includes sensors for sensing the relative heights of the respective ends of the stack, and the stacking table tilts to maintain a substantially flat, level stacking surface. The stack is then raised, and the stacking table tilts to maintain a substantially flat, level stacking surface for the next ply.

More particularly described, the preferred embodiment of the present invention comprises a folding station, a gripping and transfer device for transferring material from the folding station to subsequent processing, a sewing station for sewing a folded ply, and a stacking station. The folding station forms a separate generally Z-shaped folded ply of material from a continuous supply roll of predetermined width. The leading edge of the material is provided to the folding station from the supply roll and held by a pair of substantially flat first or bottom folding plates which move laterally across the material from the sides of the material adjacent the top surface of the material. A vertically-movable mounting carriage supporting the pair of flat folding plates then lowers, and a substantially flat second or top folding plate positioned underneath the material moves along a path substantially parallel to but spaced apart from and above the first folding plates, pulling a supply of material from the supply roll, across the top of the bottom folding plates to form a folded region in the ply. Additional holding plates then close in on the fold and the top and bottom folding plates are withdrawn, thereby firmly holding the fold in place.

Next, a pair of gripping fingers mounted to a traveling carriage moves into position adjacent the sides of the holding plates to grip the fold of the ply. The gripping fingers grasp the folded ply along the lateral edges of the holding plates and sense the presence of the ply within the fingers. The fingers close, and provided that the sensors indicate that the ply of material has been grasped, the holding plates release, and the gripping fingers withdraw from the folding station along a rail toward a sewing station, carrying the folded material and pulling more material from the supply. The carriage stops when the material has been pulled out a predetermined length, and a cutter cuts the material at the point of exit from the folding station.

At the sewing station, the carriage moves the folded ply through the sewing station at a speed synchronized to the speed of the sewing machine. The folded region of the ply is then tacked or stitched to hold the ply. After the stitch is completed, the carriage then accelerates toward a stacking station.

The carriage and gripping fingers, now carrying a sewn folded ply, approaches the stacking station and pulls the sewn folded ply across the top of a stack of similar articles, which is formed atop a vertically-movable tiltable stacking surface. The stacking surface holds a plurality of folded sewn plies which are bundled together after reaching a stack limit. When the carriage has reached a position wherein the leading edge of the ply being carried is substantially aligned with the leading edges of the other plies in the stack, a pair of vertically disposed stacking fingers descend and hold the ply against the top of a pair of stacking plates which are positioned over the top of the stack but which are movable away from the stack to allow deposition of a ply onto the stack. The ply is released by the gripping fingers on the top of the stacking plates, and the stacking plates withdraw generally horizontally across the top of the stack of plies, thereby depositing the released ply atop the stack of plies. The released ply is held against the stack by the stacking fingers as the stacking plates slide out from under the ply.

Advantageously, positive control of the ply is always maintained over the ply as the ply is released and literally "pushed" onto the stack with the stacking fingers. Since the ply is positively controlled at all times and not released to fall, the resultant stack is always neat and centered.

An elevator carrying the stack then descends; while the stack is lowered, the gripping finger carriage moves back through the sewing station to the folding station to pick up another ply. The elevator then raises the stack, and the pair of stacking plates is then repositioned over the top of the stack. When the top of the stack contacts with the bottom of the stacking plates, limit switches attached to the stacking plates provide signals indicative of the relative heights of the ends of the stack. The end with the folded region builds up height faster than the other end, and thus contacts with one of the stacking plates first. This contact actuates a limit switch which releases a brake on the stacking table, allowing tilting. The bottoms of the stacking plates provide surfaces against which the stack is pressed to induce a tilt in the stack. When the relatively lower end of the stack contacts with a stacking plate, another limit switch is actuated and the stacking surface brake is reapplied to prevent the stack from further tilting. Accordingly, the top of the stack now presents a substantially flat stacking surface for the next ply presented for stacking. Since an uneven-height or unlevel stack allows some distance for a released ply to fall and possibly become skewed, the tilting stacking table further contributes to the formation of a neat and centered stack since it always presents a flat level stacking surface.

Accordingly, it is an object of the present invention to provide an improved automatic apparatus and method for forming a coin pocket in a jacket pocket liner ply.

It is another object of the present invention to provide an apparatus for forming a generally Z-shaped fold in a substantially flat piece of material.

It is another object of the present invention to provide an improved single ply transfer apparatus which senses the presence of a workpiece transfers the workpiece from one work station and through a second work station at a speed synchronized to the second work station, and to a third work station for stacking or other processing.

It is another object of the present invention to provide an improved apparatus and method for stacking separate substantially flat workpieces.

It is another object of the present invention to provide an improved flat article stacking apparatus which always maintains positive article control to promote neat, even, and unskewed stacking.

It is another object of the present invention to provide an improved apparatus and method for stacking substantially flat workpieces which have a greater thickness at one end than another due to the presence of a fold or the like, which always presents a substantially level stacking surface to the next workpiece presented for stacking.

It is another object of the present invention to provide an improved method and apparatus for forming separate folded and sewn plies of material from a supply roll, as opposed to forming same from a stack of single plies which must be separated prior to folding and sewing.

It is another object of the present invention to provide an apparatus for forming and handling a single separate ply of material which obviates alignment problems by always positively handling the material through all processing steps.

These and other objects, features, and advantages of the present invention may be more clearly understood and appreciated from a review of the following detailed description of the preferred embodiment and by reference to the appended drawings and claims.

BRIEF DESCRIPTION OF THE DRAWINGS

FIGS. 1A and 1B illustrates the steps taken in the preferred embodiment of the present invention to form a separate folded and sewn ply from a supply roll and for stacking same.

DETAILED DESCRIPTION OF THE PREFERRED EMBODIMENT

Figure 4A:
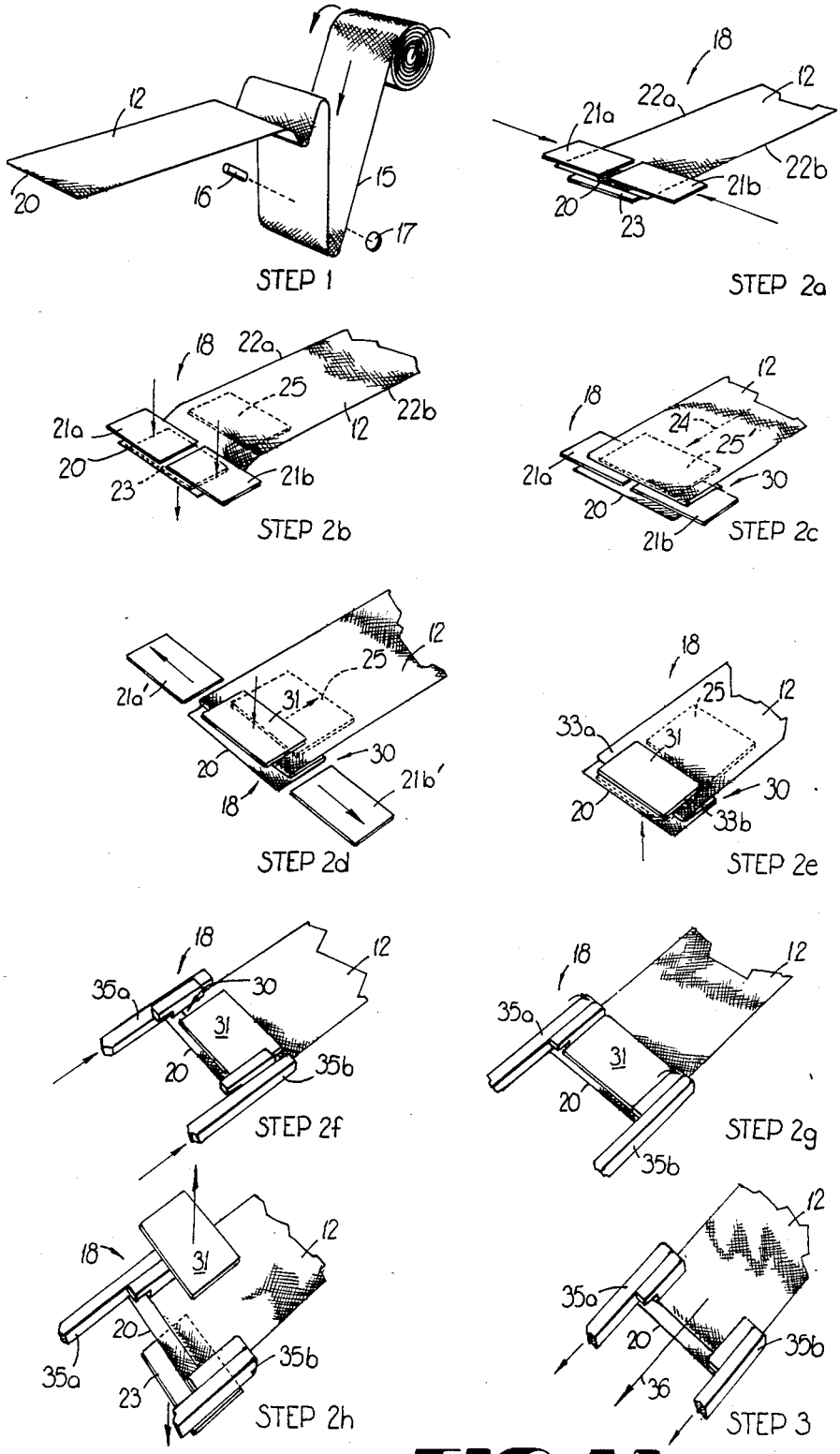
FIG. 4 is a perspective pictorial side view of the carriage and gripping finger assembly employed in the preferred embodiment of FIG. 2.
Figure 4B:
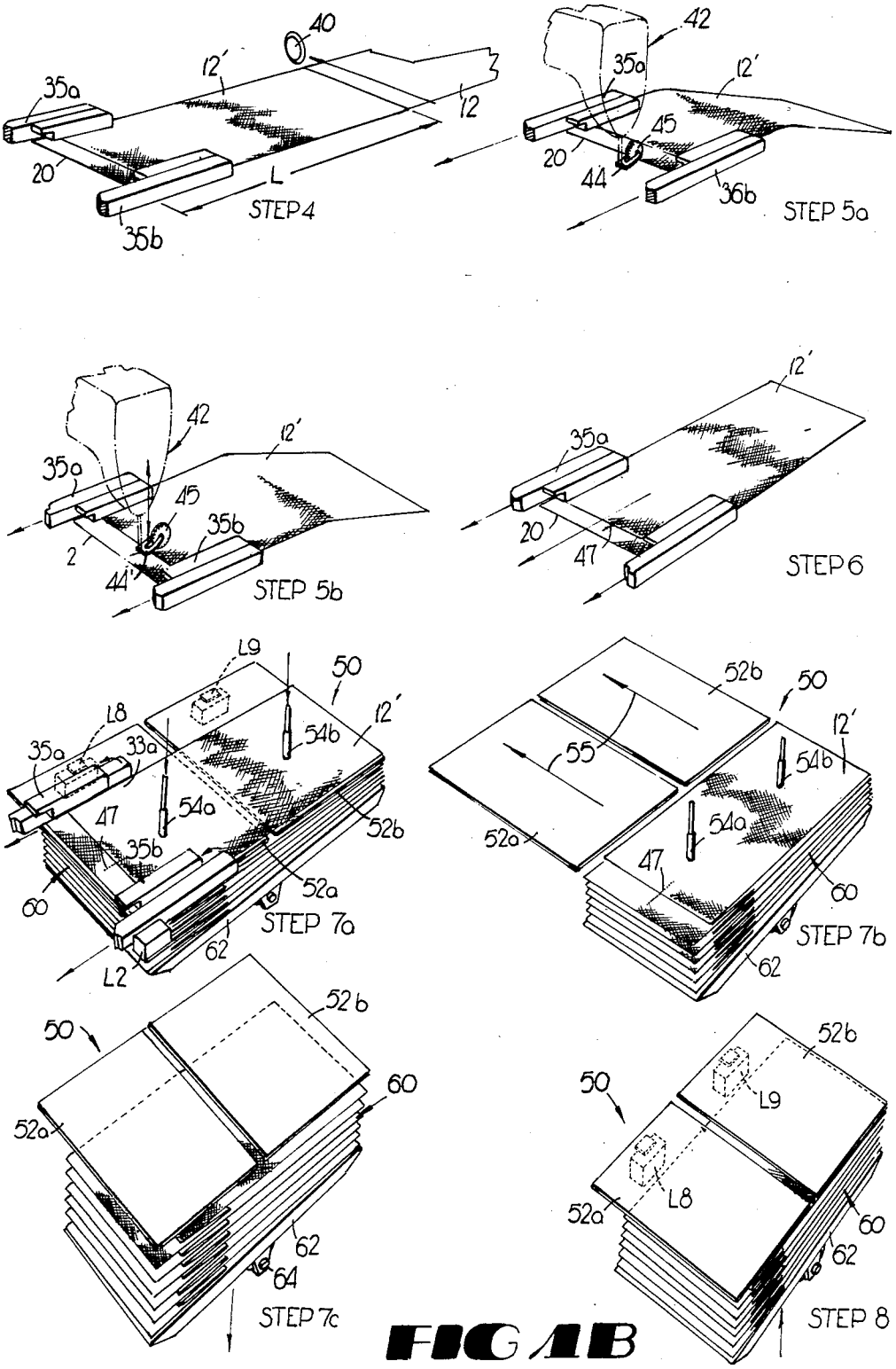

Referring now to the drawings, in which like numerals indicate like elements throughout the several views, FIG. 1 illustrates the steps taken in the disclosed preferred embodiment for forming a single folded ply from a continuous supply roll, sewing or tacking the ply to form a coin pocket, and for removing the sewn folded ply from a sewing station to a stacking station. As will be discussed in greater detail below, the preferred embodiment of the present invention employs a programmable controller 13 (FIG. 2) to control the sequence of actuation and deactuation of a plurality of pneumatic cylinders and motors employed in the preferred embodiment as the prime movers. The controller receives electrical input signals from limit switches and other sensors, and provides signal outputs to actuate solenoid valves and relays to control the pneumatic cylinders and motors. The preferred embodiment employs a model SYSMAC-S6 programmable controller commercially available from Omron Electronics, Inc. of Schaumburg, Illinois. Those skilled in the art will understand how to program such a programmable controller to perform the steps taken in the disclosed embodiment and illustrated in FIG. 1 to effectuate the forming of the single folded and sewn ply and stacking of same, after the discussion which follows.

Referring first to step 1 in FIG. 1A, a continuous supply of cloth material 12 is provided on a supply roll 14. The material on the supply roll 14 has been precut to the appropriate width desired for the completed coin pocket articles. The supply roll is driven by an 115 VAC electric motor 19 (FIG. 2) to feed the material into a loop 15 which is disposed in the path of an optical sensor 16. The optical sensor includes a light source and detector, and transmits a beam of light toward a reflector 17. Provided that the loop 15 is disposed in the path between the optical sensor 16 and reflector 17, motor of the supply roll 14 will not actuate. Should the loop 15 be drawn down sufficiently to expose the reflector, a signal is provided from the sensor 16 to the controller 13 and the motor turns on command from the controller, feeding the supply loop until the reflector is again hidden from the optical sensor. Preferably, the controller is programmed so that if a signal to drive the motor lasts longer than a predetermined time, an error condition is indicated and the motor (as well as the entire system) is halted, inasmuch as the supply roll is either empty or jammed.

Still referring to FIG. 1, the leading edge 20 of the material is then provided into a folding station 18 (FIG. 2) which operates in the steps illustrated in steps **2*a*–2*h* to impart a generally Z-shaped fold in the material. Referring first to step 2*a*, a pair of bottom fold plates 21*a*, 21*b* are moved inwardly of the material 12 from the lateral edges 22*a*, 22*b*, respectively, of the material 12 across the top surface of the material. These bottom fold plates 21 are mounted to a mounting carriage 22 (illustrated in FIG. 3), which is movable upwardly and downwardly, carrying the bottom fold plates. The bottom fold plates 21 hold the material firmly against a bottom hold plate 23 (see FIG. 3) mounted to the mounting carriage 22**, which raises and lowers together with the carriage.

At step **2*b*, the mounting carriage 22 lowers, together with the bottom fold plates 21 and bottom hold plate 23, in preparation for making a fold in the material 12. The lowering of the mounting carriage 22 creates a vertical space or gap for movement of a top fold plate 25 which is positioned beneath the material 12. The top fold plate 25 is substantially flat and is movable along a path substantially parallel to the bottom fold plates 21*a*, 22*b* as best can be seen in step 2*c*. The top fold plate 25** is referred to herein as a "top" fold plate because it ultimately is positioned above the other fold plates when the fold is formed, although it is initially positioned beneath the material.

In step **2*c*, the top fold plate 25 is moved in the direction of arrow 24 toward the leading edge 20, across the top of the bottom fold plates 21*a*, 21*b* to the position indicated at 25', pulling a quantity of material from the loop 15. It will thus be seen in step 2*c* that the movement of the top fold plate 25 across the top of the bottom fold plate creates a generally Z-shaped folded region 30 in the material. It will also be appreciated that the provision of the loop 15 in the material provides a non-resisting source of material which is pulled from the supply as the top fold plate 25 moves to the position at 25'** to form the fold.

At step **2*d*, the following sequence of actions takes place to hold the just-completed fold in preparation for further movement of the material: a top hold plate 31 mounted to the carriage 22 is lowered into position atop the folded region 30 to clamp the fold, the bottom fold plates 21*a*, 21*b* are withdrawn from the sides 22*a*, 22*b* of the material, and the top fold plate 25 is withdrawn. The motion of withdrawal of the fold plates 21, 25 and the lowering of the top hold plate 31 is very fast or virtually simultaneous, since the function of the top hold plate 31 is to hold the fold in position for removal of the ply but allowing removal by moving the bottom fold plates 21 and the top fold plate 25 out from within the folded region 30. In the preferred embodiment, both the bottom and top hold plates 23, 31 are covered with a tacky cushion of rubber or the like which frictionally resists movement of the material, while the fold plates 21, 25 are stainless steel, which easily slides out from the folded region. Thus, it will be appreciated that the lowering of the top hold plate 31 is virtually simultaneously with the removal of the top fold plates 21 and bottom fold plate 25**, yet the folded region stays in place.

At step *2e*, then, the folded region 30 remains "sandwiched" between the bottom hold plate 23 and the top hold plate 31, with side portions 33*a*, 33*b* exposed. The carriage 22 then raises to the initial starting level, preparatory to removal of the material from the folding station.

At step *2f*, a pair of gripping fingers 35*a*, 35*b* are moved into position to grasp the exposed lateral regions or portions 33*a*, 33*b* of the material. The gripping fingers 35 are mounted to a carriage 34 (FIG. 2) which withdraws the material from the folding station 18, through a sewing station, and to a stacking station as will be described.

At step *2g*, the gripping fingers 35*a*, 35*b* close, and sensors in the ends of the fingers determine whether material is present between the fingers. If so, then at step *2h* the bottom hold plate 23 is lowered and the top hold plate 31 is raised, freeing the material to be withdrawn from the folding station 18. At step 3, the carriage 34 mounting the gripping fingers 35*a*, 35*b* is withdrawn in the direction of the arrow 36.

At step 4, in FIG. 1B, the material 12, now having been released from the folding station 18, is pulled out a predetermined length to form a single elongate ply having a folded region. The carriage 34 is withdrawn away from the folding station 18 until the leading edge 20 of the material is a predetermined length L away from a cutting blade 40 mounted in the folding station 18. The carriage 34 temporarily halts, and the cutting blade 40 is moved across the material 12 to cut the material from the supply. The ply is now a separate folded ply 12' ready for further processing.

At step *5a*, the material 12' is provided to a sewing station 42 for stitching or tacking the folding region 30 to hold it together. At the sewing station, with the leading edge 20 of the now-separate ply of material 12' still held between the gripping fingers 35*a*, 35*b*, the leading edge is then fed underneath a presser foot 44 of a sewing machine, guided thereunder by a knurled wheel 45. The presser foot, which can be raised and lowered by the controller 13, is initially in the raised position and then lowered as the material is fed into the sewing machine.

At step *5b*, the material is pulled through the sewing station 42 at a rate synchronized to the speed of sewing of the sewing machine. As will be described in greater detail below, the sewing machine includes a tachometer for providing signals indicative of the speed of the sewing machine, which are provided to a circuit which drives a stepping motor which moves the carriage 34. Accordingly, the movement of the material through the sewing station 42 is precisely synchronized to the speed of sewing.

At step 6, after sewing the material 12' now includes a stitch 47 which tacks the folded region 30 together to hold the fold. The carriage 34 is then accelerated toward a stacking station 50 (FIG. 2) away from the sewing station.

Still referring to FIG. 1B, at step *7a* the material 12' is brought into a stacking station 50 where the sewn folded ply is deposited atop a stack of similar articles. In the stacking station 50, the material 12' is first pulled into a position across the top of a stainless steel first stacking plate 52 positioned toward the leading 20 of the material, and across the top of a stainless steel second stacking plate 52*b* positioned away from the leading edge of the material. The carriage 34 triggers a limit switch L2 when the material is atop both of the stacking plates 52*a*, 52*b*. Then, a pair of vertically movable stacking fingers 54*a*, 54*b* associated with the respective stacking plates 52*a*, 52*b*, descend and press the ply 12' against the stacking plates. The gripping fingers 35*a*, 35*b* then open, releasing the ply of material atop the stacking plates 52. It will be appreciated that the ply never leaves positive control since the stacking fingers contact the material at the instant the gripping fingers release the material.

Next, in FIG. *7b*, the stainless steel stacking plates 52*a*, 52*b* withdraw away from the sides of the material 12 in the direction of arrow 55, depositing the ply 12' upon the top of a stack 60 of similar articles. The stacking fingers 54*a*, 54*b*, which are fitted with a rubber tip or the like on the ends for frictional resistance to movement of the ply 12', positively hold the material in place as the relatively slick stainless steel stacking plates 52 slide out from between the ply 12' and the stack 60.

The gripping finger carriage 34 then continues to move away from the stack until it arrives at a "home" position, where it contacts with a limit switch (not illustrated). When the carriage reaches the home position, the stack 60, resting atop a tiltable stack table 62, is lowered so that the stacking plates 52*a*, 52*b* can be replaced over the top of the stack without interference from any articles in the stack. In step *7c*, the stacking plates 52*a*, 52*b* are moved back into position over the top of the stack 60.

At step 8, the stack table 62 is raised, bringing the top of the stack 60 into contact with the bottom of the stack plates 52*a*, 52*b*. Each of the stacking plates is pivotably mounted and includes limit switches L8, L9 (FIG. 5) which actuate when the stack is brought into contact. The first limit switch actuated (typically L8, which is positioned toward the end of the stack which includes the folded region) releases a tilting brake 64 (FIG. 2) momentarily, allowing tilting of the stack table 62. The controller is programmed so that when both limit switches are made the stack has reached a proper height for ply presentation and the stack elevator stops its upward movement.

Because of the build-up on the leading edge portion of the stack of plies, there is a tendency of the end of the stack with the folded region to be higher than the other end of the stack. Accordingly, in most circumstances the end of the stack with the folded region will contact with the stacking plate 52*a* positioned toward the folded region; the closing of the limit switch L8 associated with the stacking plate 52*a* causes the controller to release the brake 64, allowing the stacking table to pivot as the stack is pressed against the plate. When the limit switch L9 associated with the other, lower end of the stack is closed, due to the contacting of the stack with the rearward stacking plate 52*b*, the brake is reapplied. The stack is then in position against the bottom of the stacking plates 52*a*, 52*b* ready for presentation of a new folded and sewn ply for stacking, with the top of the stack presenting a level stacking surface for the next ply.

Figure 2:
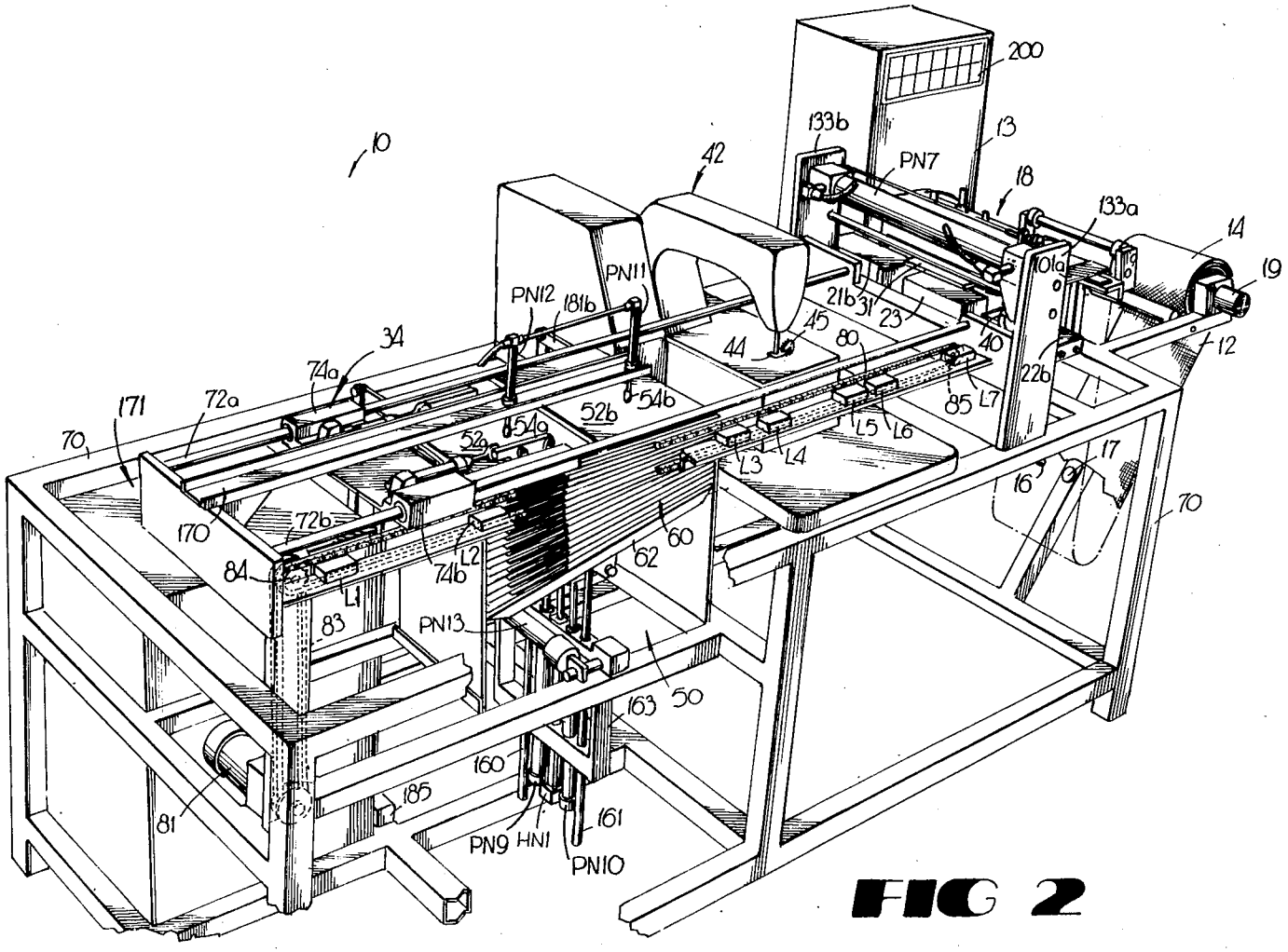
FIG. 2 is a perspective pictorial view of the preferred embodiment of a ply folding and sewing apparatus constructed in accordance with the present invention.

Referring now to FIG. 2, it may be seen that the preferred embodiment of the ply folding and sewing apparatus 10 constructed in accordance with the present invention comprises a folding station 18, a sewing staton 42, a stacking station 50, and a carriage 34 for transferring articles from the folding station, through the sewing station, and to the stacking station. The entire assembly is mounted within a tubular metal frame 70, with the folding station 18 and supply roll 14 positioned at one end, the sewing station 42 positioned in the center of the frame, and the stacking station 50 positioned toward the other end of the frame. The programmable controller 13 is also mounted to the frame 70, and connected to the various pneumatic cylinders, relays, and sensors in the system.

Figure 4:
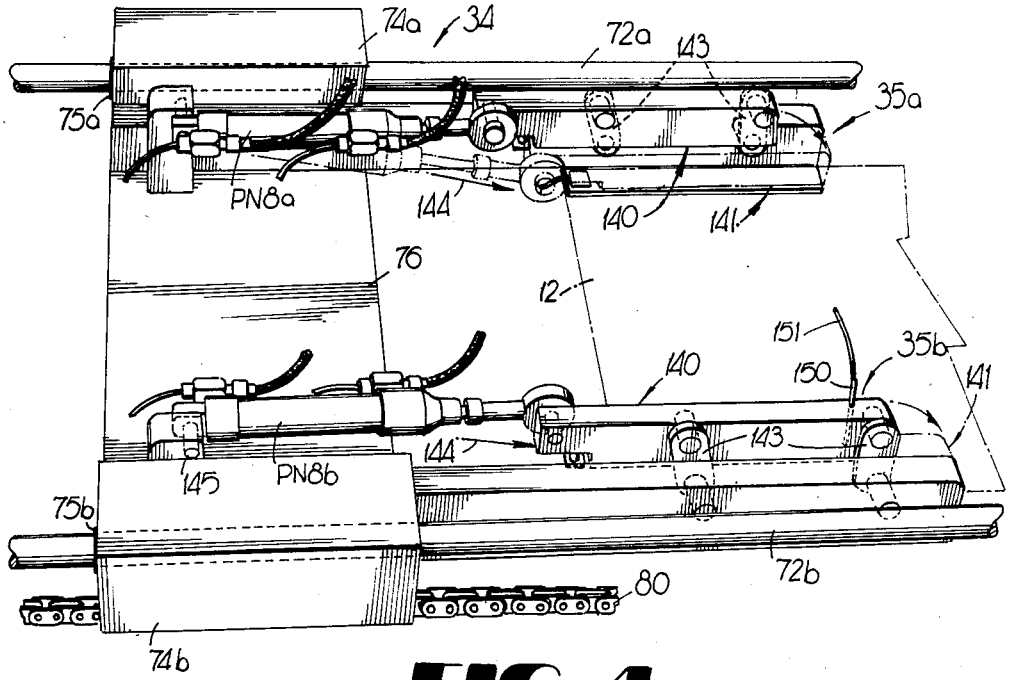

The gripping finger carriage 34 travels along a pair of parallel rods or rails 72*a*, 72*b* which are mounted to the frame 70, carrying the carriage from a position wherein the gripping fingers 35*a*, 35*b* are inside the folding station 18 to grasp a folded ply, then pulling the ply and fold through the sewing station 42, and finally pulling the sewn folded ply across the top of the stack 60. As best seen in FIG. 4, the carriage 34 is supported on the rails 72 by mounting blocks 74*a*, 74*b* which include guide sleeves 75*a*, 75*b* slidably fitted about the rails 72*a*, 72*b*. The carriage 34 is moved along the rails 72*a*, 72*b* by an endless chain 80. The chain 80 is moved by a drive sprocket 84 and idler sprocket 85, which are mounted on axles (not illustrated) in the frame 70 to support the chain 80 at each end of the frame 70.

A bidirectional stepping motor 81, also mounted to the frame 70 toward the stacking station 50, drives a drive chain 83 which in turn drives the sprocket 84 to move the chain 80. The stepping motor 81 is controlled by a pulse generator circuit (not illustrated) which receives drive signals from the controller 13 and is operative to accelerate the carriage 34, slew the carriage, and decelerate the carriage for halting motion. In addition, the pulse generator circuit synchronizes the stepping motor 81 to the speed of the sewing station 42 so that the ply may be pulled through the sewing station at the speed of sewing.

A series of limit switches L1–L7 are positioned along one of the support rails 72 and are actuated by the mounting blocks 74 of the carriage 34 as the carriage passes in proximity to the limit switch. A first or "home" limit switch L1 provides a signal to the controller 13 that the carriage has reached the home position after depositing a ply on top of the stack and should stop. This also signals the controller that the stack plates 52 can be returned to position over the stack. Limit switch L1 also indicates that the carriage 34 is clear of the stacking fingers 54*a*, 54*b* so that when the stacking cycle is complete and the stacking plates 52 have been returned into position over the top of the stack, the carriage can then be returned back to the folding station 18.

A limit switch L2 is positioned proximate to the leading edge end of the stack 60 to signal the controller that the carriage is at a position for releasing the ply atop the stack plates; this triggers the stacking fingers 54 to descend. A limit switch L3 positioned towards the trailing edge end of the stack signals the controller that the sewing step has been completed so that the carriage may be moved toward the stacking station. In the preferred embodiment, pulses from the sewing machine tachometer are provided to a stepping motor controller circuit so that the sewing machine literally drives the carriage 34 in synchronism. Accordingly, the controller is preferably programmed to recognize an error condition and halt operation if switch L3 is not actuated a predetermined time delay after starting to sew.

Limit switch L4 signals the controller that the carriage has reached a position in the sewing station to lower the presser foot and begin sewing. In the disclosed embodiment, L4 also signals that the material has been pulled out a predetermined length and actuates the cutter 40. It will of course be understood that another limit switch can be positioned at another location to vary this predetermined length.

Limit switch L5, which is actuated as the carriage moves toward the folding station, tells the controller to finish a folding cycle by raising the carriage 22, since the gripping fingers are approaching the folding station. Limit switch L6 signals the controller to decelerate the carriage when moving to the right in FIG. 2 prior to reaching the home position at the folding station 18. Finally, a limit switch L7 is the "home" position at the folding station end of the assembly, and signals the controller that the gripping fingers of the carriage are in position for gripping a folded ply in the folding station.

Figure 3:
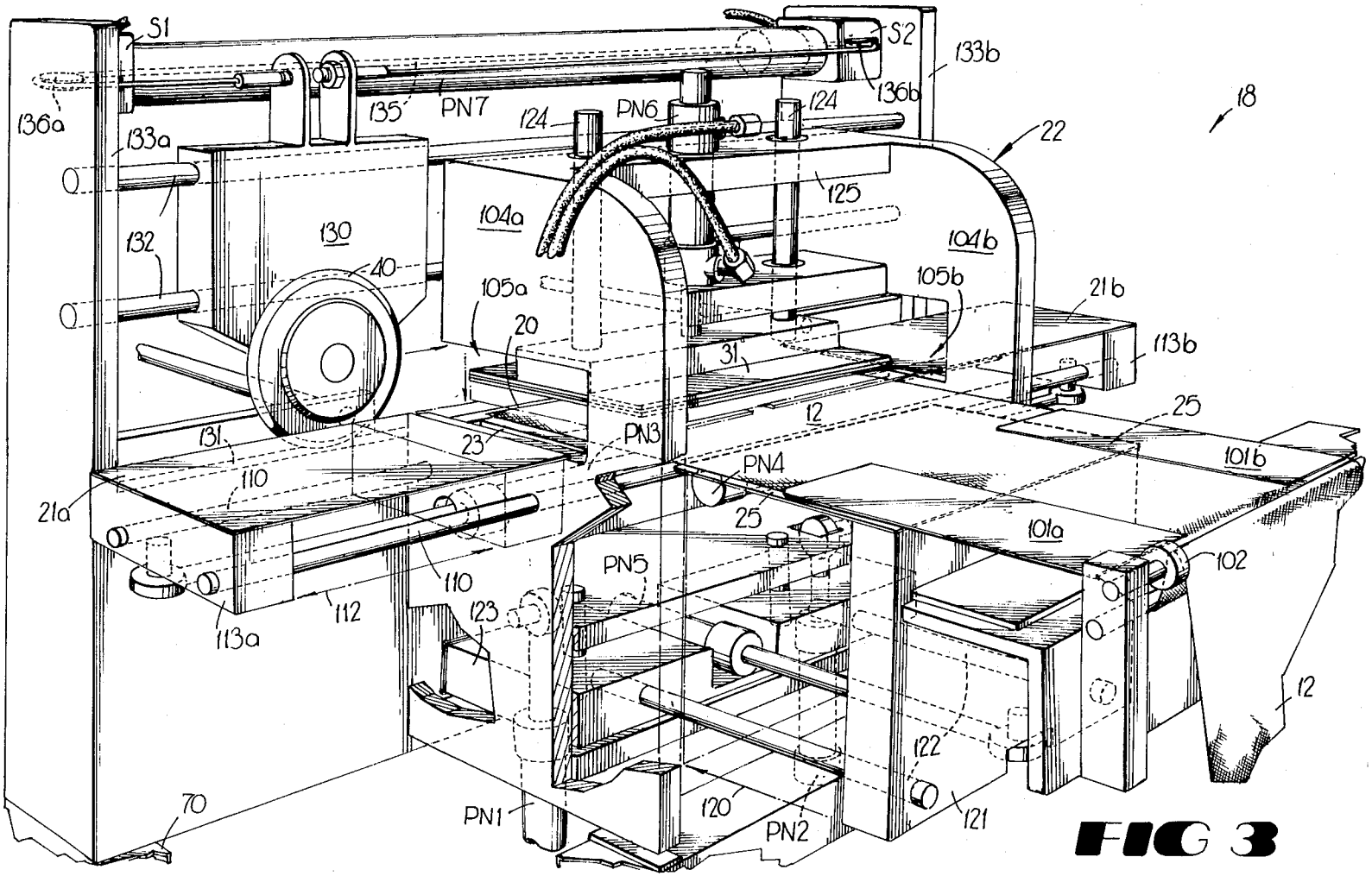
FIG. 3 is a perspective pictorial rear view of the folding station employed in the preferred embodiment of FIG. 2.

Referring now to FIG. 3, next will be described the details of the construction of the preferred embodiment of the folding station 18 which is operative to fold the material 12 into a generally Z-shape and to cut the material after the folded region has been withdrawn from the folding station. The material 12 is provided from the supply roll over a first guide roller 102 and into a pair of guides 101*a*, 101*b* which direct the material into the folding station. Initially, the leading edge 20 of the material is fed into the folding station until the leading edge is positioned adjacent the path of the cutting blade 40 and atop a generally rectangular horizontal bottom hold plate 23 which is mounted in the mounting carriage 22. The mounting carriage 22 comprises a pair of vertically upright mounting plates 104*a*, 104*b* which are movable upwardly and downwardly by pneumatic cylinders PN1, PN2 mounted beneath the carriage 22. Each of the mounting plates 104*a*, 104*b* includes a generally rectangular notched or cut-out portion 105*a*, 105*b* which allow the bottom fold plates 21*a*, 21*b* to move in over the top of the material 12.

Each of the bottom fold plates 21*a*, 21*b* are supported for lateral movement on the carriage 22 with respect to the material 12 on support rods 110, and moved inwardly and outwardly in the direction of arrow 112 by pneumatic cylinders PN3, PN4 mounted to the carriage 22. The ends of the actuator rods of cylinders PN3, PN4 are attached to a mounting block 113*a*, 113*b*, which support the bottom fold plates 21*a*, 21*b* respectively. As discussed above in connection with FIGS. 1A and 1B, the first step taken at the beginning of a processing cycle is to move the bottom fold plates 21*a*, 21*b* into position with the plates 21 over the top of the material 12 to hold the material against the bottom hold plate 23.

In order to make the fold in the material, it will be recalled from the discussion above that the top fold plate 25 is movable in the direction of arrow 120 to pull material from a supply loop over the top of the bottom fold plates 21*a*, 21*b* to form the generally Z-shaped folded region. The top fold plate 25 is mounted to a mounting block 121 which travels along horizontal guide or support rods 122 powered by a pneumatic cylinder PN5. The support rods 122 and cylinder PN5 are affixed to a subframe 123, in turn fastened to the frame 70, and does not form a part of the mounting carriage 22.

Also mounted to the mounting carriage 22 for upward and downward movement is the top hold plate 31, which holds the folded region of the material until the gripping fingers have moved into position to grasp the material. The top hold plate 31 is supported by guide or support rods 124 and moves downwardly and upwardly by a pneumatic cylinder PN6, which is mounted to a cross-brace 125 between the mounting plates 104*a*, 104*b*.

Disposed for movement in the direction along the leading edge 20 of the material 12 is the cutting blade 40, which is mounted to a traveling mounting block 130. The cutting blade 40 in the preferred embodiment is a model 304 dull pressure-operative knife made by Ohio Knife Corporation of Cincinnati, Oh., which cuts by pressure of a relatively sharp blade against a hardened tool steel cutting surface 131. The cutting blade 40 is rotatably mounted and spring-loaded in the mounting block 130. The mounting block 130 is supported by a pair of parallel horizontal guide or support rods 132, which in turn are mounted to a pair of upright stanchions 133*a*, 133*b*. The upright stanchions 133 are rigidly fixed to the frame 70, as best illustrated in FIG. 2.

The mounting block 130 for the cutting blade 40 is moved along the support rods 132 by a pneumatic cylinder PN7 positioned between the stanchions 133*a*, 133*b*. Pneumatic cylinder PN7 is a double acting, doubled-end rod type pneumatic cylinder having a wire cable 135 attached to each end of the piston for causing the mounting block 130 to traverse back and forth. The cable 135 is pulled around idler pulleys 136*a*, 136*b* mounted to the stanchions 133*a*, 133*b*, respectively. Use of the wire cable 135 instead of a rigid piston rod or plunger allows for the traversing action of the cutting blade mounting block 130 without extension of a rigid piston rod beyond the planes of the stanchions 133, thereby conserving space. The preferred double acting double end pneumatic cylinder PN7 is a model 1002×0400×1"×12" manufactured by Tol-O-Matic Inc. of Minneapolis, Minn., which includes integral magnetic proximity sensors S1, S2 for sensing the position of the ferromagnetic piston. Signals from the proximity sensors S1, S2 are provided to the controller 13 to signal the completion of a cut.

FIG. 4 illustrates the details of construction of the gripping finger carriage 34. Each of the gripping fingers 35*a*, 35*b* is constructed in a general pantograph linkage fashion, with a horizontally-disposed upper finger portion 140 and a lower finger portion 141. The upper and lower finger portions 140, 141 form horizontal parallel sides of a pantograph, while a pair of vertically-disposed parallel linkages 143, 144, pivotably mounted at each end to the upper finger portion 140 and lower finger portion 141, form the opposite sides of the pantograph and allow the upper finger portion 140 to be lowered onto the lower finger portion 141*d* to grasp the ply along the length of the finger portions 140, 141. Pivotably mounted parallel-connected pneumatic cylinders PN8*a*, PN8*b* when actuated push the upper finger portion 140 in the direction of arrow 144 to lower the upper finger portion. The non-operative end of the pneumatic cylinders PN8 are mounted on a rod bearing 145 to the mounting block 74, and allows the pneumatic cylinder to pivot slightly as the gripping fingers are raised and lowered.

Each of the gripping fingers 35*a*, 35*b* includes a material sensor for providing a signal to the controller to indicate that the gripping fingers have successfully engaged a folded ply of material in the folding station. In the preferred embodiment, the material sensors comprise an electrode 150 mounted to extend through the bottom of the upper finger portion 140; a wire 151 carries a signal to the controller. The lower finger portion 141 is maintained at ground potential through the metal-on-metal construction, while the electrode 150 is electrically isolated from the metal of the upper finger portion by insulation.

Should the upper finger portion 140 be lowered onto the lower finger portion 141 without a ply of material disposed therebetween, the electrode 150 will contact the lower finger portion and be forced to ground potential, thereby carrying a signal along the wire 151 to the controller, indicating that the fingers have closed without gripping a ply. The material of the ply serves as an insulator, preventing the electrode 150 from reaching ground potential if material is gripped between the upper finger portion 140 and lower finger portion 141. In the preferred embodiment, each of the gripping fingers 35*a*, 35*b* includes such a material sensor and the controller is programmed to signal a fault condition and cease operation in the event that both material sensors do not simultaneously detect the presence of material in the gripping fingers.

Figure 6:
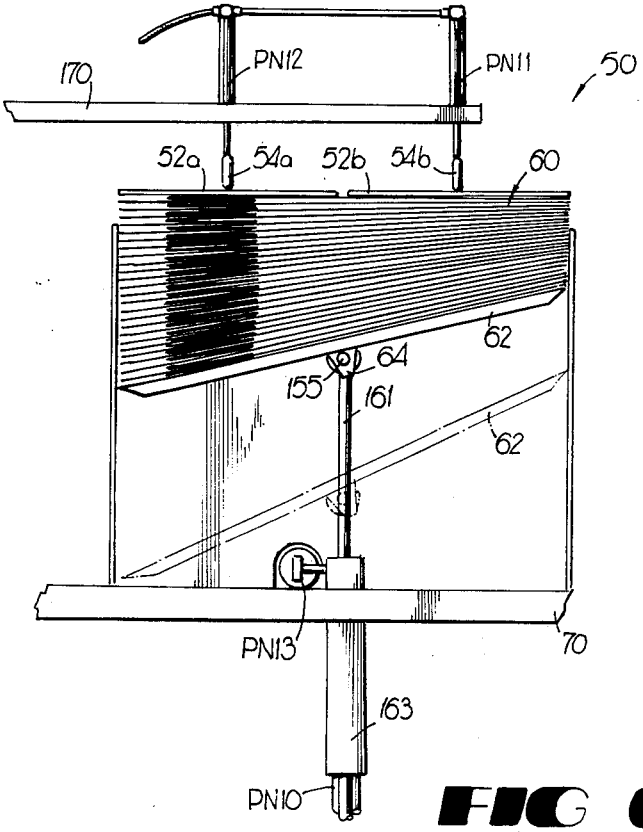
FIG. 6 is a front view of the stacking station employed in the preferred embodiment of FIG. 2.
Figure 5:
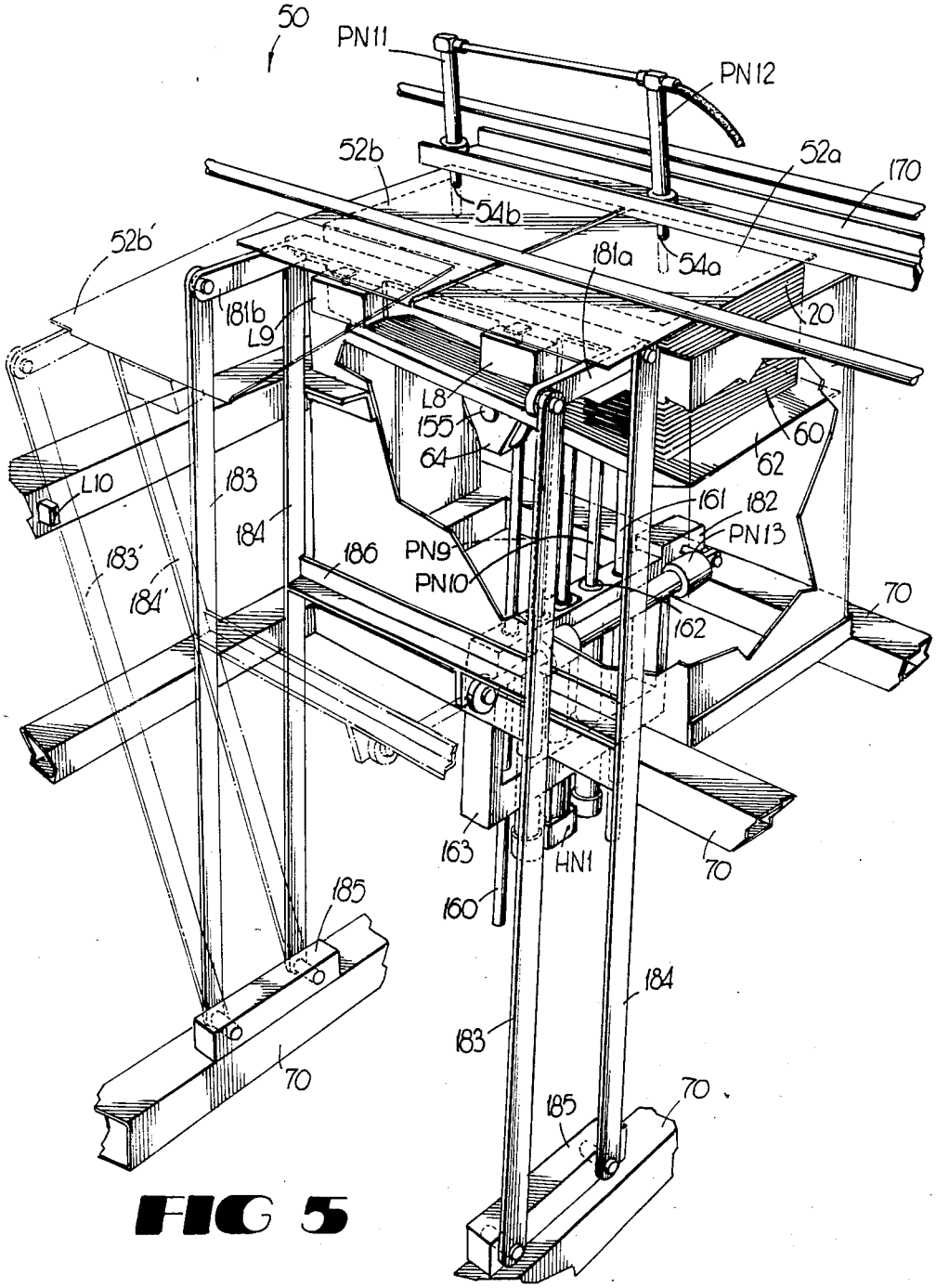
FIG. 5 is a perspective pictorial view of the rear of the stacking station employed in the preferred embodiment of FIG. 2.

Referring now to FIGS. 5 and 6, the stacking station 50 will be described in greater detail. The view illustrated in FIG. 5 is from the rear of the stacking station to illustrate the movement and structure of the stacking plates 52*a*, 52*b*. From the discussion above it will be recalled that the ply of material is deposited by the gripping finger carriage 34 atop the stacking plates 52*a*, 52*b*, with the stacking plate 52*a* disposed toward the leading edges of the plies in the stack 60. As described above in connection with FIG. 1B, the stack of folded sewn plies 60 is formed atop a stack table 62, which serves initially as the stacking surface; it will be of course understood that the topmost ply in the stack 60 provides the stacking surface for subsequent plies presented to the stack table 62.

The stack table 62 is pivotably mounted on a pivotable support axle 155 and is raised by a pair of pneumatic cylinders PN9, PN10 to a topped-out position for receiving a ply. The stack table however is variably positionable, with the aid of an air-over-oil hydraulic cylinder HN1 which serves as a brake for the stack table 62. It will be appreciated that use of a hydraulic cylinder HN1 allows variable positioning of the stacking surface so that the top of the stack 60 is always at the same height. Those skilled in the art will understand and appreciate that air-over-oil hydraulic cylinders are commercially available and may be easily adapted to be driven by the air pressure of the system. When the stack is raised and actuates both the limit switches L8, L9, signals from the controller actuate solenoid valves at both the inlet and outlet of cylinder HN1, causing the stack table to stop.

Control over the tilting of the stack table 62 about its axle 155 is effectuated by a disc brake 64. The brake 64 in the preferred embodiment is a Tol-O-Matic model P10DAR0708-0000. As discussed above, when the stack 60 is raised into contact with the stack plates 52*a*, 52*b*, the first limit switch of L8 or L9 to actuate releases the brake 64, allowing the table to tilt as the stack is pressed against the plates, and the actuation of the remaining switch L8 or L9 reapplies the brake. It will therefore be understood that these actions result in a substantially level top of the stack.

The stack table 62 is supported for raising and lowering by a pair of vertically extending support rods or guides 160, 161 which are received in guide sleeves 162 in a rectangular mounting subframe 163. Mounting subframe 163 is of course rigidly affixed to the frame 70. Extending and retracting the pneumatic cylinders PN9, PN10 and braking with the hydraulic cylinder HN1 therefore results in raising and lowering the stack table 62 in a smooth, balanced fashion supported by the support rods 160, 161 which prevent lateral tilting of the stack table.

It will now be understood that the preferred embodiment moves the stack table down and tilts same to accomodate ply build-up, and then moves the stack back up to a stacking level immediately beneath the stack plates 52. Accordingly, the present invention maintains a substantially level stacking surface at all times and always at the same height for receiving a ply to obviate stacking problems encountered in release-and-fall type stackers.

Still referring to FIG. 5, the stacking fingers 54*a*, 54*b* comprise the rubber-tipped ends of the actuator rods of a pair of simultaneously actuated pneumatic cylinders PN11, PN12, which are affixed to a horizontal support arm 170. As best seen in FIG. 2, the support arm 170 is pivotably mounted to the frame 70 at one end 171 and cantilevered over the stack 60 so that the stacking fingers 54 can be lifted away from the top of the stack to allow operator access to the stack for bundling and removal.

Each of the stacking fingers 54*a*, 54*b* moves downwardly to the position shown in dotted relief in FIG. 5 under control of the controller immediately after a ply is placed atop the stacking plates 52*a*, 52*b* for deposition on the stack. The stacking fingers 54*a*, 54*b* remain extended, holding the ply against the stacking plates 52*a*, 52*b* until the gripping fingers have completely released the ply and moved to the home position at limit switch L1. The stacking fingers are retracted by cylinders PN11, PN12 after the stacking plates 52*a*, 52*b* have been withdrawn to the position shown at 52*b*′ to allow the presented ply to contact with the top of the stack.

The mechanism for withdrawing the stacking plates 52*a*, 52*b* is illustrated in FIG. 5. The withdrawal apparatus comprises a pantograph linkage. Each of the stacking plates 52*a*, 52*b* is pivotably mounted to a substantially horizontal linkage 181*a*, 181*b*, respectively; each of the stacking plates is independently pivotable. Upward movement of the stacking plates 52*a*, 52*b* actuates limit switches L8, L9 respectively, signalling the controller that one end or the other of the stack has first contacted the stacking plates as the stack table 62 is raised.

With reference to the linkage arms for the horizontal linkage 181*b*, it being understood that the horizontal linkage 181*a* is supported in a similar manner, a pair of parallel vertically-extending support arms 183, 184 is pivotably mounted to a mounting block 185, which in turn is mounted to the frame 70. Each of the support arms 183, 184 is also pivotably mounted to the horizontal linkage 181*b* so that the entire assembly generally moves as a pantograph. As shown in dotted relief in FIG. 5, the support arms 183, 184 assume the position indicated at 183′, 184′, withdrawing the stacking plates to the position indicated at 52*a*′, 52*b*′ away from the top of the stack 60. A limit switch L10 is actuated at the farthest extent of movement of the arm 183′, signalling the controller.

A horizontally-disposed pneumatic cylinder PN13 is moutned to move the support arms 183, 184 between the rest position with the stack plates disposed over the stack, and the withdrawn position at 183′, 184′. The end of the actuator arm of the pneumatic cylinder PN13 is pivotably mounted to a horizontal brace 186 which resists movement of the support arms 183, 184 out of the plane of the pantographs formed by the support arms and horizontal linkages. It will therefore be appreciated that extension and retraction of the pneumatic cylinder PN13 moves the stack plates 52*a*, 52*b* into position over the top of the stack 60 or withdrawn away from the stack to allow a presented ply to be stacked or to allow an operator access to the stack for bundling and removal. The non-operative end of the pneumatic cylinder PN13 is pivotably mounted in turn to a mounting block 182, which in turn is rigidly affixed to the frame 70.

It will be understood by those skilled in the art that the sewing station 42 is a conventional sewing machine including thread undertrimmer and needle positioner which has been modified in order to adapt the sewing machine for operation with the present invention. In particular, the sewing machine is fitted with a pneumatic cylinder (not illustrated) to raise and lower the presser foot 44 onto the material after the leading edge of the material has been fed underneath the knurled guide wheel 45, as shown in step 5*a* in FIG. 1B.

It will also be understood that conventional sewing machines are operative at a rate determined by a motor associated with the sewing machine; in order to successfully sew the folded region of the ply, the preferred embodiment of the present invention includes a tachometer (not illustrated) or other means for sensing the rotational speed of the sewing machine motor. Signals from the tachometer are provided to the controller 13 which is responsive to provide signals to the stepping motor 81 which moves the gripping finger carriage 34 so that the ply of material is pulled through the sewing station 42 at a rate synchronized to the sewing speed.

Finally, the sewing machine 42 is provided with a thread tension sensor (not illustrated) and thread supply sensor (not illustrated), which provide signals to the controller to indicate that the sewing station 42 is either out of thread or has experienced a broken thread. These sensors provide signals to the controller 13 which halt the sequence of operations due to the inability of the sewing station to sew. These sensors, together with the optical sensor 16 for monitoring the supply roll, and various timing functions performed by the controller, make the present invention fully automatic and operator-unattended. In the event of a malfunction, e.g., the sewing machine has not completed its sewing due to a broken thread or the carriage does not advance to trigger limit switch L3, the system halts operation.

It will also be understood that a plurality of manual switches are provided on a control panel 200 in the controller 13 for providing manual actuation of certain sequences and functions. Included in the preferred embodiment is an "auto/manual" switch for selecting automatic or manual operation, a "carriage forward" switch for moving the gripper finger carriage 34 in the forward direction toward the stacking station, a stacker unload switch for withdrawing the stacking plates 52 to allow access to the stacked plies, a self-explanatory "emergency stop" switch, a "start" switch for initiating action, a "reset" switch for setting the system to an initialized position with all pneumatic actuators placed in position for beginning operation, and a "carriage reverse" switch for moving the gripping finger carriage 34 away from the folding station toward the stacking station.

In addition, the preferred embodiment includes switches for configuring the system to fold and stitch, to fold only, or to cut only. It will be understood by those skilled in the art that the manufacture of the stitched folded coin pocket liner articles described herein may occasionally result in some waste. In addition, since the coin pocket is generally included as the pocket liner for but one jacket pocket, another non-folded liner of the same length must be provided for lining the other jacket pocket. Thus, it is possible to condition the preferred embodiment of the present invention to fold and stitch every ply, every other ply, or not at all. It will therefore be appreciated that the apparatus can be conditioned to manufacture either type of article so as to compensate for a missmatch in the numbers of jacket pocket liners which may result from running out of material, unacceptable material, or a broken thread during a sewing cycle.

It will now be understood by those skilled in the art that the folding station 18 comprises means for holding one end of a length of material from a supply roll, means for folding the material in a generally Z-shape to form a folding region, and means for cutting the material to form a single elongated folded ply. It will be further understood that the folding station performs a method for forming a generally Z-shaped ply of material, comprising the steps of holding one end of the ply, moving a first plate into position across one surface of the ply to provide a first folding surface, and moving a second plate initially positioned beneath the ply across the first plate along a path substantially parallel to the first plate but spaced apart from the first plate with the ply held therebetween to form a generally Z-shaped fold.

It will be further understood that the disclosed steps performed by the apparatus disclosed herein carries out a method for forming a coin pocket in a ply of material, comprising the steps of folding the ply in a generally Z-shape with a folding means, cutting the material to form an elongate single ply, grasping one end of the folded ply with a gripping means, removing the folded ply from the folding means to a sewing station, moving the folded ply through the sewing station in synchronization with a sewing machine, sewing the folded portion of the ply to hold the folded portion together, removing the sewn folded ply from the sewing station to a stacking station, and then stacking the folded plies to allow easy bundling and removal.

It will also be understood that there has been disclosed an apparatus for stacking a plurality of substantially flat workpieces having one end thicker than another end due to the presence of a fold or the like. The apparatus will be understood to comprise a stacking surface for holding a stack of workpieces, stack height sensing means for sensing the relative heights of the ends of the stack formed on the stacking surface, and tilting means responsive to the stack height sensing for tilting the stacking surface formed by the top of the stack so that the top of the stack of workpieces presents a relatively flat stacking surface for a workpiece presented for stacking. The apparatus described above performs a method for stacking substantially flat workpieces comprising the steps of presenting the workpiece to a stacking surface by pulling the workpiece across the stacking surface with a gripping means, releasing the workpiece on the top of a stacking plate disposed across the top of the stack, positively holding the ply against the top of the stack as the stacking plates are withdrawn to deposit the ply on the top of the stack, and tilting the stack to maintain a level stacking surface.

Finally, it will be understood by those skilled in the art that the steps illustrated in FIGS. 1A and 1B represent a possible series and sequence of steps which may be taken to accomplish the objectives of the present invention, but that other sequences of steps may be employed with success in accomplishing the formation of a folded sewn ply and the stacking thereof in preparation for providing a stack of such plies for further processing. In particular, it will be understood that certain sequences may be slightly modified so as to enhance simultaneity or economy of motion, for example, it is specifically within the contemplation of the present invention that the gripping finger carriage 34 can be moved back toward the folding station prior to raising the stack table 62. It is also within the contemplation of the present invention that other types of sensors and processing devices may be included for performing other operations on the ply of material in addition to those described herein, for sensing proper operation and for triggering certain sequences and operations possible in the disclosed embodiment while still remaining in the principal objectives of the present invention, forming a sewn folded ply and stacking same atop a stack of similarly formed articles to form a neat even stack of plies.

Accordingly, it will be understood that the preferred embodiment of the present invention has been disclosed by way of example and that other modifications and alterations may occur to those skilled in the art without departing from the scope and spirit of the appended claims.

We claim:

1. An apparatus for forming a folded ply of material, comprising:

means for holding one end of a length of material from a supply roll;

means for folding the material in a generally Z-shape to form a folded region while said one end is held by said holding means; and means for receiving the ply including the folded region from said folding means and for cutting the material to form a single elongate folded ply.

2. The apparatus of claim 1, further comprising means for receiving the folded ply from said cutting means and for sewing the folded ply to fasten said folded region together.

3. The apparatus of claim 1, further comprising means for receiving the folded ply from said cutting means and for stacking the folded plies to form a stack of folded plies.

4. The apparatus of claim 3, further comprising means for transferring the folded ply from said holding means through said cutting means and to said stacking means while maintaining continuous contact with the material to promote neat even stacking by said stacking means.

5. The apparatus of claim 4, wherein said transferring means comprises ply gripping means movable between a first position for grasping one end of a folded ply and a second position wherein a gripped ply is positively deposited atop a stack of plies.

6. The apparatus of claim 3, further comprising means for tilting said stacking means in response to ply build-up at one end of said stack to present a substantially level stacking surface for a folded ply presented to stacking means for stacking.

7. The apparatus of claim 6, further comprising stack height sensing means for sensing ply build-up by sensing the relative heights of the ends of the stack of folded plies on said stacking surface, and wherein said tilting means is responsive to said stack height sensing means for tilting said stacking surface so that the top of the stack of folded plies presents a substantially flat stacking surface for a folded ply presented for stacking.

8. A method for forming a generally Z-shaped folded ply of material, comprising the steps of:

(1) holding one end of the ply with a holding means;

(2) moving a first plate across one surface of the ply to provide a first folding surface while the ply is held by the holding means;

(3) moving a second plate across the first plate along a path substantially parallel to the first plate but spaced apart from the first plate with the ply held therebetween to form a generally Z-shaped fold;

(4) removing the first and second plates from within the fold; and (5) releasing the holding means to allow removal of the ply.

9. An apparatus for forming a coin pocket in a ply of material, comprising:

(a) a folding station for forming a generally Z-shaped ply of material, comprising:

means for holding one end of a length of material provided from a supply roll, a substantially flat first folding plate movable between a flat position and a second position adjacent the top surface of the material, a substantially flat second folding plate adjacent the bottom surface of the material movable between a first position and a second position along a path substantially parallel to but spaced apart from said first folding plate, means for moving said first folding plate between said first and said second positions, means for moving said second folding plate between said first and said second positions to force the material of the ply to be displaced, thereby forming a folded region in the material, and means for cutting the folded material to form a separate folded ply;

(b) a gripping and transfer means, comprising:

gripping means for grasping a folded ply at said folding station and movable from a first position operatively associated with said folding station to a second position operatively associated with a sewing station and to a third position operatively associated with a stacking station, means for sensing a folded ply when said gripping means are positioned at said folding station, and means responsive to said folded ply sensing means for moving said gripping means from said folding station to said sewing station at a first rate, for moving a folded ply through said sewing station at a sewing rate, and for moving a sewn folded ply from said sewing station to said stacking means at a third rate;

(c) a sewing station for sewing a folded ply moved therethrough by said gripping means at said sewing rate to form a sewn pocket; and (d) a stacking station, comprising:

a stacking surface for holding a stack of folded plies, stack height sensing means for sensing the relative heights of the ends of the stack of folded plies on said stacking surface, and tilting means responsive to said stack height sensing means for tilting said stacking surface so that the top of the stack of folded plies presents a relatively flat stacking surface for a folded ply presented for stacking by said gripping means.

10. The apparatus of claim 9, further comprising elevator means for raising and lowering said stacking surface to allow said gripping means to move over the top of the stack to present a folded ply for stacking and to return to said first position.

11. An apparatus for forming a coin pocket in a ply of material, comprising:

means for folding the material in a generally Z-shape to form a folded region;

means for sewing said folded region to form a coin pocket on the ply; and means for stacking a plurality of folded plies to form a stack of folded plies.

12. The apparatus of claim 11, further comprising means for transferring the ply from said holding means through said sewing means and to said stacking means while continuously contacting the ply to promote neat even stacking by said stacking means.

13. The apparatus of claim 12, wherein said transferring means comprises ply gripping means movable between a first position for grasping one end of the ply and a second positoin wherein a gripped ply is positively deposited atop a stack of plies.

14. The apparatus of claim 11, further comprising means for tilting said stacking means in response to ply build-up at one end of said stack to present a substantially level stacking surface for a ply presented to stacking means for stacking.

15. The apparatus of claim 16, further comprising stack height sensing means for sensing ply build-up by sensing the relative heights of the ends of the stack of plies on said stacking surface, and wherein said tilting means is responsive to said stack height sensing means for tilting said stacking surface so that the top of the stack of plies presents a substantially flat stacking surface for a ply presented for stacking.

16. The apparatus of claim 11, wherein the material is provided from a continuous roll to said folding means, and further comprising means for cutting the material to form a single folded ply.

17. Apparatus for stacking a plurality of substantially flat workpieces having one end thicker than another end, comprising:

a stacking surface for holding a stack of workpieces;

stack height sensing means for sensing the relative heights of the ends of said stack of workpieces on said stacking surface; and tilting means responsive to said stack height sensing means for tilting said stacking surface in response to ply build-up at one end of said stack so that the top of said stack of workpieces presents a substantially flat stacking surface for a workpiece presented for stacking.

18. The apparatus of claim 17, further comprising means for moving a workpiece across the top of said stacking surface to present a workpiece for stacking, and elevator means for raising and lowering said stacking surface to allow said workpiece moving means to move over the top of the stack to present a workpiece for stacking.

19. The apparatus of claim 18, further comprising workpiece depositing means for positively depositing a workpiece on the top of said stack.

20. The apparatus of claim 19, wherein said workpiece depositing means comprises a stacking plate capable of assuming a first position disposed over the top of said stack for receiving a workpiece for stacking and a second position withdrawn away from said stack, and means for biasing a workpiece placed atop said stacking plate against the top of said stack when said stacking plate assumes said second position.

21. A method for stacking a plurality of substantially flat workpieces having one end thicker than another end to form a stack of workpieces, comprising the steps of:

(1) presenting the workpiece to a stacking surface with a workpiece moving means by pulling the workpiece along a path across the stacking surface;
(2) releasing the workpiece from the moving means on the top of the stacking surface;
(3) transferring the workpiece from the stacking surface to the top of a stack;
(4) lowering the stack to allow the moving means to move back across the top of the stack to on a return path obtain another workpiece;
(5) releasing the stack to tilt; and
(6) raising the stack to contact with the underside of the stacking surface to tilt the stack to compensate for uneven height of the ends of the stack.

* * * * *